US006758998B2

(12) United States Patent
Debalme et al.

(10) Patent No.: US 6,758,998 B2
(45) Date of Patent: Jul. 6, 2004

(54) METHOD AND DEVICE FOR INSERTING FIBERS IN EXPANDED FORM INTO A CAVITY OR DEPOSITING THEM ON A SURFACE

(75) Inventors: Jean-Paul Debalme, Chambery (FR); Gilles Rocher, Chambery (FR)

(73) Assignee: Saint-Gobain Vetrotex France, Chambery (FR)

( * ) Notice: Subject to any disclaimer, the term of this patent is extended or adjusted under 35 U.S.C. 154(b) by 254 days.

(21) Appl. No.: 10/076,673

(22) Filed: Feb. 19, 2002

(65) Prior Publication Data

US 2002/0121526 A1 Sep. 5, 2002

(30) Foreign Application Priority Data

Mar. 2, 2001 (FR) ..... 01 02991

(51) Int. Cl.[7] ..... B65H 51/16

(52) U.S. Cl. ..... 264/257; 226/7; 226/97.1; 264/517; 264/121; 425/80.1; 425/82.1

(58) Field of Search ..... 264/514, 121, 264/257, 115; 226/7, 97.1; 425/80.1, 82.1

(56) References Cited

U.S. PATENT DOCUMENTS 3,212,691 A * 10/1965 Lockshaw ..... 226/7
3,232,557 A * 2/1966 Winn, Jr. ..... 242/146
3,655,862 A * 4/1972 Dorschner et al. ..... 264/555
4,148,676 A 4/1979 Paquette et al.
4,215,805 A 8/1980 Nielsen
4,569,471 A * 2/1986 Ingemansson et al. ..... 228/176
5,766,541 A 6/1998 Knutsson et al.
5,976,453 A * 11/1999 Nilsson et al. ..... 264/555
2001/0011780 A1 * 8/2001 Knutsson ..... 264/28

* cited by examiner

*Primary Examiner*—Mary Lynn Theisen
(74) *Attorney, Agent, or Firm*—Oblon, Spivak, McClelland, Maier & Neustadt, P.C.

(57) ABSTRACT

A method for filling a receiver with expanded fibers includes the steps of feeding at least one bundle of fibers from at least one roving; introducing the at least one bundle into a portable tool having a manual gripping element, a spray nozzle, an air supply device connected for supplying air to the nozzle, an extraction system configured to hold the at least one bundle and feed the at least one bundle to the nozzle, and an inlet guide positioned to guide the at least one bundle to the extraction system; and using the air supply device to expand the fibers of the at least one bundle in said spray nozzle, and spray the expanded fibers into the receiver.

23 Claims, 3 Drawing Sheets

METHOD AND DEVICE FOR INSERTING FIBERS IN EXPANDED FORM INTO A CAVITY OR DEPOSITING THEM ON A SURFACE

CROSS REFERENCE TO RELATED APPLICATIONS

The present application is based on French patent application no. 01/02991, filed on Mar. 2, 2001, which is hereby incorporated by reference herein, int its entirety.

BACKGROUND OF THE INVENTION

1. Field of the Invention

The invention relates to a method and device for inserting, into a receiving housing such as a cavity, or for depositing on a surface, continuous fibers, for example glass fibers, in expanded form, with a view to acoustically and/or thermally insulating the deposition housing or environment.

2. Description of the Background

It is known from U.S. Pat. No. 4,569,471, for deadening the noise of an acoustic exhaust muffler for an engine, to fill the space surrounding the exhaust gas discharge cylinder with glass fibers, which fibers consist of continuous glass filaments supplied from a yarn roving and are in the form of a bulked product. There, a glass yarn roving is treated by wheels for stretching out/paying out the yarn, and for guiding the yarn, a braking wheel for controlling the tension in the yarn, and a compressed air apparatus for spraying the yarn into the space that is to be filled, the air injected into the apparatus allowing the filaments to be separated, entangled and sprayed.

However, this device, installed at a factory for the mass-production of exhaust mufflers requires numerous take-up elements for stretching out, guiding and controlling the tension in the yarn as far as the spraying apparatus. Moreover, it is not possible for this device to be used in other applications of filling or depositing, the receiving elements (cavity or surface) of which are too bulky to be filled in factory, or which are fixed.

SUMMARY OF THE INVENTION

It is therefore an object of the invention to provide a device for filling or depositing expanded fibers, which is simpler to use and more compact than known devices, thus making it lighter in weight and portable.

It is another object of the invention to provide a method and device for filling or depositing expanded fibers, which is easy to handle and to direct, therefore allowing the fibers to be sprayed in any direction.

According to a feature of the invention, a device comprises a spraying apparatus for charging, in expanded form, fibers from at least one bundle of fibers taken from at least one roving, the apparatus comprising a portable tool having a manual gripping element, the portable tool comprising a nozzle for spraying the fibers of the at least one bundle; an air supply device connected for supplying air to the nozzle so as to expand fibers of a bundle therein; an extraction system configured to hold the at least one bundle and feed the at least one bundle to the nozzle; and an inlet guide positioned to guide the at least one bundle to the extraction system.

This device is therefore portable, which has the advantage of enabling it to be used on receiving elements which cannot be transported or which are difficult to access.

The bundle of the roving may be formed of a number of continuous or discontinuous filaments made of glass or thermoplastic. Depending on the application, it may be envisaged that the device will comprise several rovings, the bundles of which are paid out and bulked by the spraying apparatus together and simultaneously.

In the case of the use of a single roving, the latter may be portable, being placed in a basket.

According to one feature, the bundle extraction system has two cylindrical rollers rotating in opposite directions and between which the bundle passes, and an outlet guide arranged at the outlet of the rollers and which takes up the bundle. The rotational speed of the rollers gives the bundle its linear speed of travel.

According to another feature, a device for guiding the bundle towards the inlet of the apparatus is provided an the outside of the body of the apparatus and consists, for example, of an eyelet or a flexible tube. In the case of several bundles, a device for guiding the bundles is provided on the outside of the body of the apparatus and consists of a row of eyelets arranged along an axis parallel to the axes of rotation of the rollers.

Preferrably, there is provided a debundling system which consists of an associated spreader bar system at the roving outlet or at the inlet to the spraying apparatus.

The extraction system advantageously operates using a pneumatic motor.

According to another feature, the spraying apparatus has the form of a gun, the handle of which constitutes the holding element and houses the pneumatic motor.

Preferably the air supply to the nozzle and the air supply to the motor came from the same source, such as a pneumatic compressor, so as to simplify the device as far as possible.

Advantageously, means of recovering air which has been exhausted from the pneumatic motor, consist of a pipe which is connected to the exhaust region of the pneumatic motor and is arranged to open, laterally to the outlet guide.

BRIEF DESCRIPTION OF THE DRAWINGS

Other advantages and features will become apparent in the description which follows with reference to the appended drawings, in which.

DETAILED DESCRIPTION OF THE PREFERRED EMBODIMENT

Figure 1:
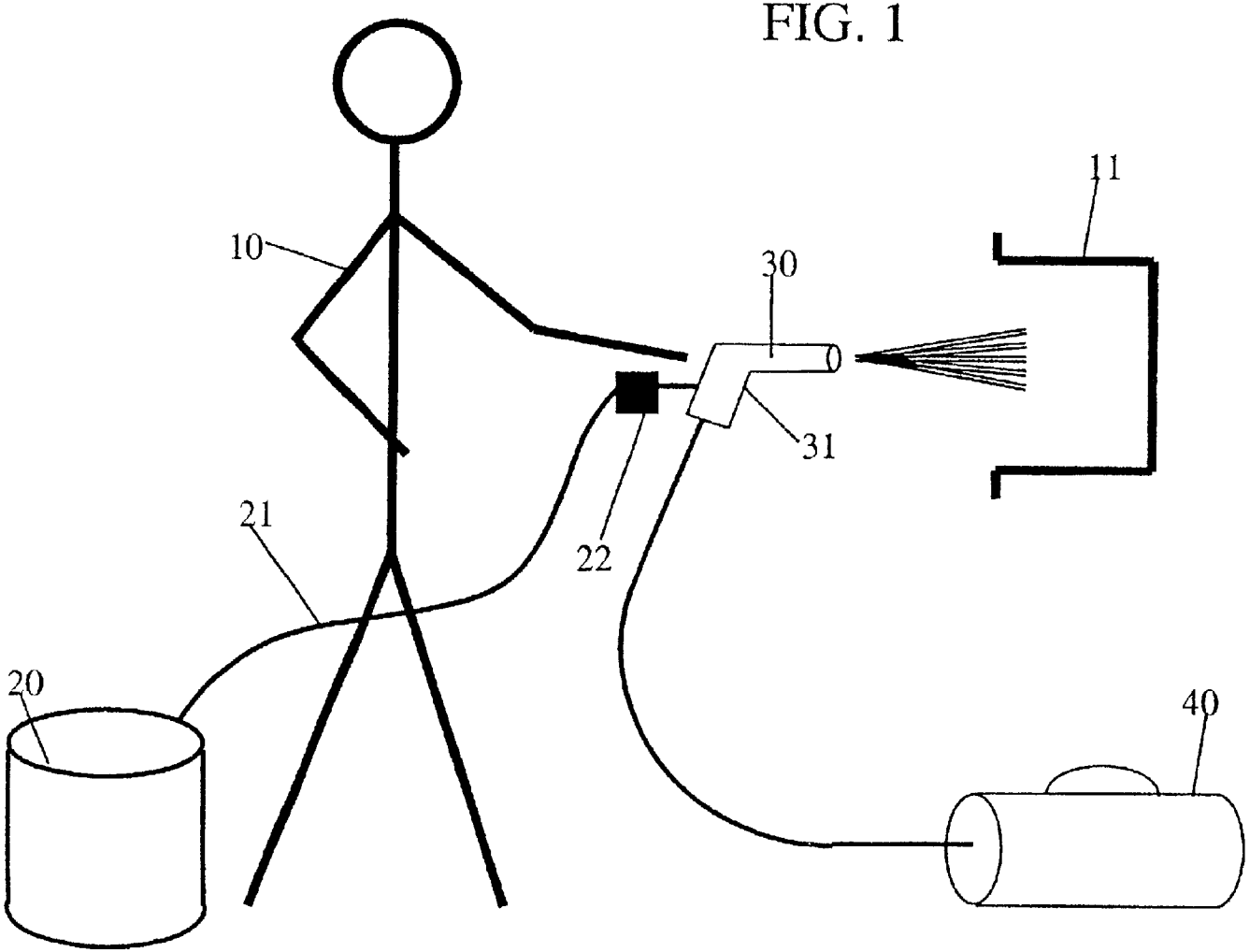
FIG. 1 is a schematic view of the device of the invention handled by an operator.

FIG. 1 shows the portable device of the invention which allows an operator 10 to insert continuous or discontinuous fibers, for example glass fibers, into or onto a receiving element 11 so that the fibers can expand to form a bulked product, regardless of its location and/or ease of access, such as the roof space of a house. The receiving element is defined as any volumetric accommodating housing such as a cavity, a gap, or alternatively any surface onto which the fibers can come to rest.

According to the invention, at least one roving 20 formed of at least one continuous bundle 21 of fibers, is fed to a bundle spraying apparatus 30 such as the spray gun supplied with compressed air from a compressed gas source 40 such as a compressor or compressed gas reservoir, and sprayed by the spraying apparatus in an expanded form into a receiving element.

To increase the fiber spray rate, provision may be made for the spraying apparatus to be fed with several roving bundles 21. Thus, several rovings for example are paid out simultaneously, the rovings being placed on their delivery palette at a distance from the point of spraying. Furthermore, depending on the end-use of the bulked product, each roving may be made of a different material, for example glass or thermoplastic.

For convenience and depending on the accessibility of the receiving element, when just one feed roving 20 is enough, this roving is then designed to be readily portable. The roving is housed, for example, in a basket with a handle to make it easier to transport and to handle the roving during the fiber spraying operation. It is also possible to find a roving support which is suitable for carrying on the operator's back.

The spraying apparatus 30 is in the form of a portable tool, such as a gun, provided with a handle 31 so that it can be held by the operator. The apparatus is built ergonomically so as to best fulfil its portable function. Thus, the gun may be associated with an extension piece, in the manner of a butt, so that it can be wedged under the operator's armpit, avoiding the need to carry it at arm's-length when the bulking operation proves fairly long.

Figure 2:
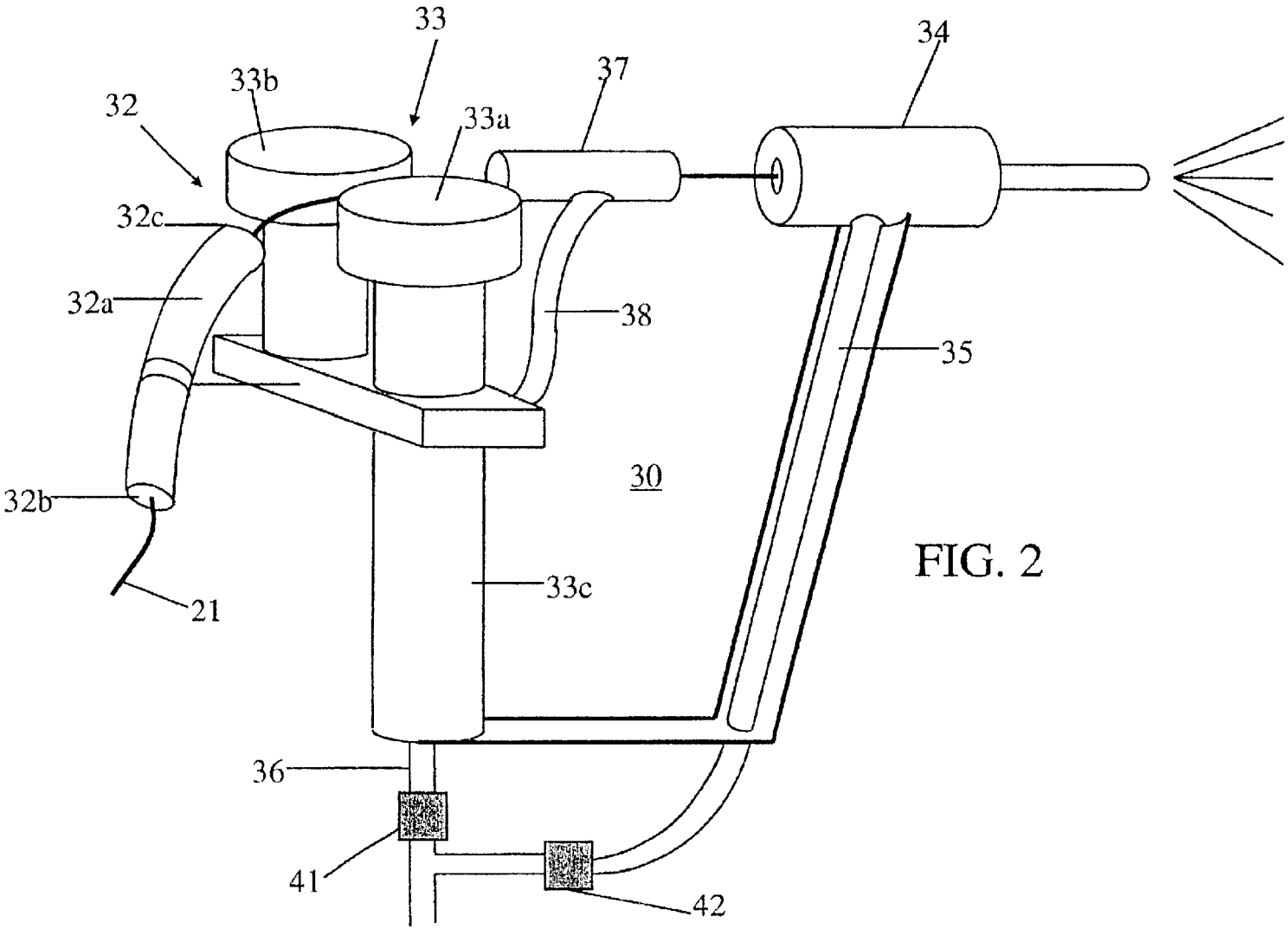
FIG. 2 is a perspective and internal view of the spraying apparatus according to the invention.

The internal structure of the spraying apparatus 30, as illustrated in FIG. 2, consists of a bundle feed inlet 32 for a bundle extraction system 33, an expansion nozzle 34 and an air inlet 35 for introducing the compressed air for spraying the bundle through the nozzle.

The bundle feed inlet 32 has a guide device 32*a*, such as a flexible guide tube, which has an open inlet end 32*b* and an open outlet end 32*c* opening onto the extraction system 33. The guide device 32*a* may also be in the form of a simple eyelet holding the bundle together.

The extraction system 33 which is used for paying out and entraining the bundle is made up of two cylindrical rollers 33*a* and 33*b* rotating in opposite directions, between which the bundle 21 is held and passes at a defined speed. The bundle 21 is therefore paid out from the roving and pulled by means of the two rollers which are driven by a motor 33*c*.

The guide device 32*a* together with the front part of the extraction system 33 are arranged on the outside of the body of the apparatus so as to be directly accessible to make it easier to introduce the bundle between the rollers at the start of paying-out.

The presence of the guide device 32*a* at the inlet to the gun helps to reduce the cohesion of the fibers of the bundle before it is introduced between the two rotating rollers.

As an option, a spreader box system 22, well known in the prior art and consisting of at least three small cylinders arranged in a staggered configuration to allow the bundle to pass straddlewise over them, may be provided. This system encourages debundling. The bundle passes through the spreader bar system after it has been paid out from the roving or as it enters the spraying apparatus.

The drive motor 33*c* for the two rollers is preferably pneumatic because then just one power source must be used. Furthermore, its small size means that it can advantageously be housed in the body of the handle 31 of the gun. Furthermore, as will be seen below, the air supply to the motor via a pipe 36 is made easier because it can operate using the air also supplied to the nozzle 31 for expanding the fibers.

The extraction system 33 also comprises an outlet guide 37, such as a rigid tube, arranged between the rollers 33*a*, 33*b* and the nozzle 34, and through which the bundle 21 passes. The guide 37 has a lateral duct 38, such as a flexible pipe, connected to the exhaust side of the motor 33*c* to form air recovery means. The exhaust air is thus channelled into the duct 38 to open into the guide 37 and thus induce the bundle 21 to leave the rollers.

The expansion nozzle 34 is situated downstream of the outlet guide 37, in the direction in which the bundle is conveyed through the guide. Compressed air is also injected into the nozzle 34 via the air inlet or pipe 35, transversely to the direction of arrival of the bundle. Advantageously, the air supply to this pipe 35 is the same one as that 36 to the motor 33*c*. This air is supplied by the pneumatic compressor 40 associated with two separate pressure reducers 41, 42 for regulating the air pressure in each respective pipe 35 and 36. In may, of course, also be taken from a main compressed air source available at the work site.

The speed of the air through the nozzle 34 is higher than the linear speed of the bundle so as to cause the filaments or fibers of which the bundle is made to vibrate and explode, that is to say separate its filaments.

In the use of the device of the invention, the operator takes the portable equipment to the site where the expanded fibers are to be sprayed. The operator manually pays out a portion of bundle 21, the end of which he threads into the guide device 32*a*, then inserts between the two rotating rollers 33*a*, 33*b*. The operator then switches on the pneumatic motor 33*c*, which causes the rollers to rotate so as to pay out the roving. The exhaust air is recovered via the duct 38 so as to draw the bundle through the outlet guide 37.

In parallel with this, compressed air is injected into the nozzle 34 via the pipe 35 so that it arrives at right angles to the direction of the filaments, so as to destroy their initial cohesion and entangle them. The compressed air injected into the nozzle also plays a part in spraying the bundle out of the nozzle in bulked form.

Having sprayed the desired amount of fiber, the operator stops the spraying apparatus and, for example using scissors, cuts through the bundle leaving the nozzle in expanded form, which means that it is not necessary to rethread the device by once again bringing the bundle between the rollers and trapping it there if the apparatus is to be used again immediately. As an alternative, it is possible to envisage a cutter which, triggered manually, cuts through the bundle leaving the extraction system and/or downstream of the nozzle.

Of course, several rovings may be paid out simultaneously. The various roving bundles are then introduced into the guide device 32*a* and pinched together in the extraction system 33.

Figure 3:
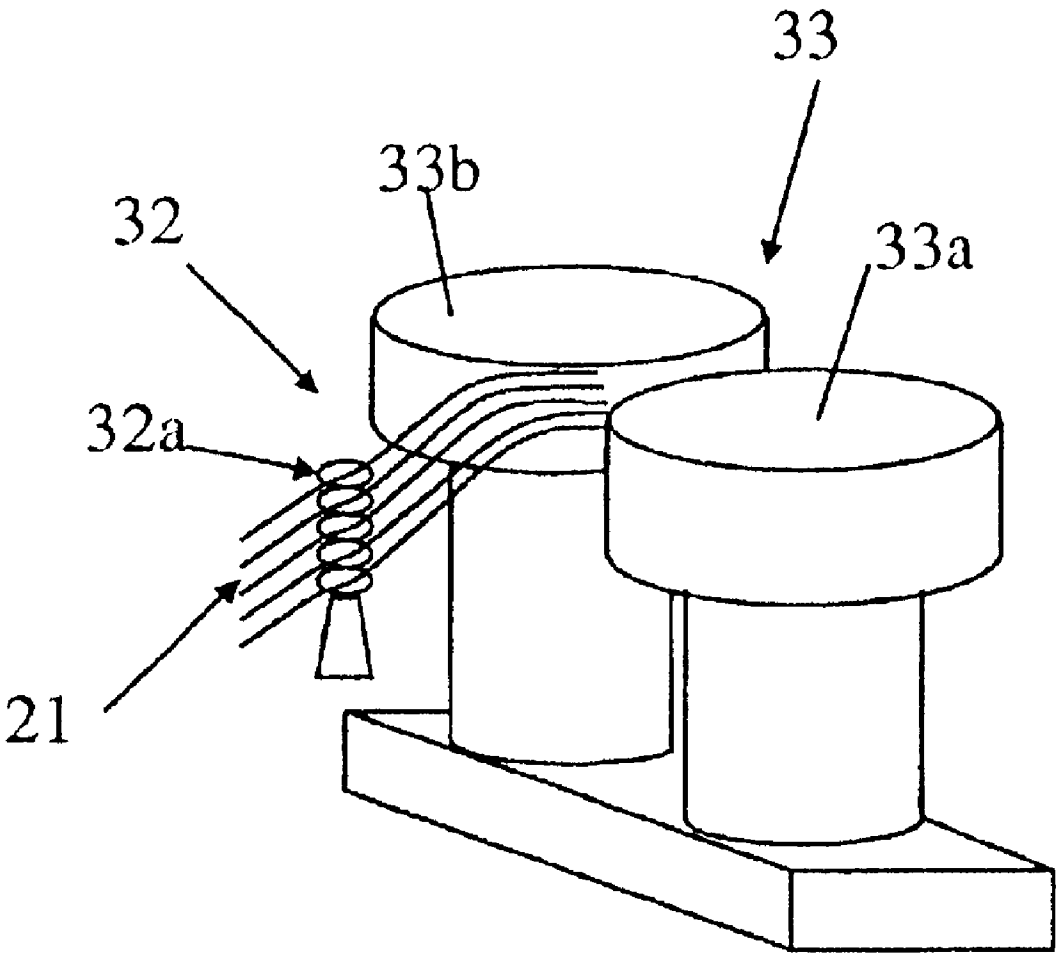
FIG. 3 is a part view of FIG. 2 with several bundles introduced into the apparatus.

If a great many rovings, for example more than four rovings, are paid out simultaneously, the guide device 32*a* may consist of a vertical row of eyelets which are fixed to a common support, the axis of which is parallel to the axes of rotation of the rollers, so as to spread the bundles across the entire width of the rollers (FIG. 3). The bundles are thus pinched between the rollers parallel to one another in a plane parallel to the axes of rotation of the rollers and are paid out at the same speed, without the possibility of there being any slippage of the bundles on each other, which would occur if they were passed through one single guide eyelet.

Bringing the bundles together at the time of their expansion and spraying ensures better mixing of the bulked product obtained in or on the receiving element 11. When each roving is made of a different material, the bulking and mixing of the various materials are thus performed simultaneously.

What is claimed is:

1. A spraying apparatus for charging, in expanded form, fibers from at least one bundle of fibers taken from at least one roving, the apparatus comprising a portable tool having a manual gripping element, the portable tool comprising:

a nozzle for spraying the fibers of the at least one bundle;

an air supply device connected for supplying air to the nozzle so as to expand fibers of a bundle therein;

an extraction system configured to hold the at least one bundle and feed the at least one bundle to the nozzle; and an inlet guide positioned to guide the at least one bundle to the extraction system.

2. The apparatus according to claim 1, wherein the extraction system comprises two cylindrical rollers rotating in opposite directions and between which the at least one bundle can pass while being pinched therebetween.

3. The apparatus according to claim 2, wherein the extraction system further comprises an outlet guide arranged adjacent the rollers, at a position to take up the bundle leaving the rollers.

4. The apparatus according to claim 4, including a pneumatic motor connected to drive the rollers of the extraction system.

5. The apparatus according to claim 4, wherein the spraying apparatus has the form of a gun whose handle comprises the holding element and houses the pneumatic motor.

6. The apparatus according to claim 4, wherein the air supply is connected to supply air to drive the pneumatic motor.

7. The apparatus according to claim 1, wherein the roving is in a basket.

8. The apparatus according to claim 1, wherein at least part of said inlet guide is placed outside of said tool.

9. The apparatus according to claim 8, wherein the inlet guide comprises a flexible tube.

10. The apparatus according to claim 8, wherein the inlet guide comprises at least one eyelet.

11. The apparatus according to claim 1, further comprising a debundling system including a spreader bar.

12. The apparatus according to claim 4, further comprising means for recovering air which has been exhausted from the pneumatic motor.

13. The apparatus according to claim 12, wherein the air-recovery means comprises a duct which connects to an exhaust of the pneumatic motor and opens laterally to the outlet guide.

14. The apparatus according to claim 1, wherein the at least one bundle of the roving is formed of a plurality of filaments.

15. The apparatus according to claim 1, wherein said inlet guide comprises a row of eyelets arranged along an axis parallel to an axes of rotation of the rollers for guiding a plurality of said bundles.

16. The apparatus according to claim 1, wherein said air supply device is connected for supplying air to the nozzle in a direction transverse to a direction of movement of the at least one bundle therein.

17. The apparatus according to claim 6, further comprising means for controlling proportions of the air supplied to the nozzle and to the pneumatic motor.

18. A method for spraying expanded fibers, comprising the steps of:

feeding at least one bundle of fibers from at least one roving;

introducing said at least one bundle into a portable tool having a manual gripping element, a spray nozzle, an air supply device connected for supplying air to the nozzle, an extraction system configured to hold the at least one bundle and feed the at least one bundle to the nozzle, and an inlet guide positioned to guide the at least one bundle to the extraction system;

using the air supply device to expand the fibers of the at least one bundle in said spray nozzle, and spray the expanded fibers.

19. The method of claim 18, wherein said feeding step comprises simultaneously feeding at least two of said bundles.

20. The method of claim 18, wherein said fibers are glass fibers.

21. The method of claim 18, wherein said fibers are thermoplastic fibers.

22. The method of claim 18, wherein said expanding step comprises supplying air to the spray nozzle in a direction transverse to a direction of movement of a bundle therein.

23. The method of claim 18, wherein said spraying step comprises filling a receiver with the sprayed fibers.

* * * * *